US008537034B2

(12) United States Patent
Greene et al.

(10) Patent No.: US 8,537,034 B2
(45) Date of Patent: Sep. 17, 2013

(54) OBSTACLE DETECTION AND NOTIFICATION SYSTEM

(75) Inventors: Randall A. Greene, Greenwich, CT (US); Paul Levine, Valhalla, NY (US); Louis Simons, Mamaroneck, NY (US); Robert D. Teter, Hopewell Junction, NY (US)

(73) Assignee: Safe Flight Instrument Corporation, White Plains, NY (US)

( * ) Notice: Subject to any disclaimer, the term of this patent is extended or adjusted under 35 U.S.C. 154(b) by 143 days.

(21) Appl. No.: 13/296,029

(22) Filed: Nov. 14, 2011

(65) Prior Publication Data

US 2013/0120164 A1 May 16, 2013

(51) Int. Cl.
*G08B 21/00* (2006.01)

(52) U.S. Cl.
USPC ..... 340/946; 73/178 H; 244/17.11; 340/961; 701/301

(58) Field of Classification Search
USPC ..... 340/946, 961, 963; 701/301; 73/178 H; 244/17.11, 17.13
See application file for complete search history.

(56) References Cited

U.S. PATENT DOCUMENTS 5,252,912 A 10/1993 Merritt et al.
6,002,348 A 12/1999 Greene et al.
7,286,912 B2 * 10/2007 Rubin et al. ..... 701/9
2002/0153485 A1 * 10/2002 Nixon et al. ..... 250/330
2005/0113985 A1 * 5/2005 Greene ..... 701/9
2005/0237226 A1 10/2005 Judge et al.
2006/0238377 A1 * 10/2006 Stiles et al. ..... 340/979

FOREIGN PATENT DOCUMENTS

GB 2 408 492 6/2005

OTHER PUBLICATIONS

Combined Search and Examination Report under Sections 17 and 18(3) dated Mar. 1, 2013, directed to GB Application No. 1220480.6; 6 pages.

* cited by examiner

*Primary Examiner* — Brent Swarthout
(74) *Attorney, Agent, or Firm* — Morrison & Foerster LLP

(57) ABSTRACT

A power line warning system for a helicopter, comprising a positioning system operable to determine the coordinates of the helicopter, an obstacle coordinate database comprising the coordinates of at least a portion of a first power line, a sensor operable to detect electromagnetic radiation from the first power line, and a visual display operable to represent a position of the first power line relative to the helicopter is described. When the coordinates of the first power line are within a predetermined distance of the coordinates of the helicopter, wherein the representation of the position of the first power line is modified when the sensor detects electromagnetic radiation from the first power line.

21 Claims, 4 Drawing Sheets

OBSTACLE DETECTION AND NOTIFICATION SYSTEM

FIELD OF THE DISCLOSURE

This generally relates to systems and techniques for detecting obstacles in proximity to transportation devices and providing notification of obstacles to transportation device operators. More particularly, this relates to systems and techniques for detecting power lines and providing a visual display of the location of the power lines relative to a helicopter.

BACKGROUND

Detection and avoidance of obstacles is a primary function of any transportation device operator. Airborne transportation device operators, in particular, must be acutely aware of obstacles in their proximity. Without defined obstacle-free transportation channels—such as roads and shipping lanes—the potential for collision in an airborne transportation device is substantially greater.

There are numerous accidents each year where a helicopter strikes an electrical power line. Because power lines can quickly entangle and ensnare a helicopter's rotors, these accidents are often fatal. These accidents can occur on helicopter Emergency Medical Service flights, where the pilot is typically navigating an unfamiliar landing zone. These accidents also occur at night, even on very routine flights, where the helicopter operator suffers a momentary lack of situational awareness.

There are many solutions to avoiding power lines and other obstacles. The basic solution is a "see-and-avoid" approach—the operator sees the power line or other obstacles and takes the necessary evasive maneuvers to avoid a collision. This solution is critically dependent on a number of factors: the operator's ability to make reliable visual contact with the obstacles, the operator's alertness, and the operator's competence.

Recognizing the limits to the see-and-avoid approach, some helicopter manufacturers equip their airframes with "wire cutters" or other sharp blades that protrude from the top and bottom of the aircraft. The wire cutters are intended to cut the power lines before the lines can damage or entangle the helicopter's rotor system. This solution is oftentimes ineffective when the cutters are not properly positioned to engage the power lines and, when effective, can cause significant damage to electrical infrastructure.

U.S. Pat. No. 6,002,348, assigned to Safe Flight Instrument Corporation, the disclosure of which is incorporated by reference herein in its entirety, teaches an airborne power line detector and warning system which includes a low frequency radio and antenna for detecting an AC signal of about 50 to 60 hertz, that is, the oscillating frequency of electric current in the United States and Europe. The system provides an audible alarm to alert the pilot to power lines in proximity to the device. Optical laser-based systems have also been developed for detecting obstacles in proximity to the device, including power lines.

More generally, Terrain Awareness and Warning Systems ("TAWS") and Enhanced Ground Proximity Warning Systems ("EGPWS") provide limited alerts to transportation device operators for potential collisions. These systems employ a positioning system, an obstacle coordinates database, and a visual display. The positioning system identifies the coordinates of the transportation device, which are then correlated with the obstacle coordinates database to establish a set of obstacles in proximity to the device. The visual display renders a depiction of the obstacles in proximity to the device and their relative positions to the transportation device. Some TAWS and EGPWS combine the transportation device's altitude—obtained through a barometric or radar altimeter—with the set of obstacles in proximity to the device to determine the potential for collision and notify the operator when the probability of a collision exceeds a predetermined threshold. For example, if the transportation device's altitude is lower than the elevation of an obstacle in proximity to the device, the system alerts the pilot that an evasive maneuver is necessary. An example of such a system is the "MK XXII Helicopter Enhanced Ground Proximity Warning System" manufactured by Honeywell International, Inc. The efficacy of such systems, however, is dependent on the accuracy of the data in the obstacle coordinates database.

TAWS may be enhanced for helicopter operators. An example is the HeliTAWS™ system manufactured by Sandel Avionics, Inc. In these systems, the obstacle coordinate database has been expanded to include the location of known power lines. The power lines are then depicted on the visual display to improve the pilot's situational awareness. These systems prove ineffective when the coordinates of the power lines are not entered correctly, where new power lines are installed after the last revision to the obstacle coordinates database, or where power lines have been relocated since the last revision to the obstacle coordinates database.

SUMMARY

This disclosure relates to a system for detecting and displaying obstacles in proximity to transportation devices. The system advantageously improves operator awareness, while simultaneously reducing operator distraction. Also, the system advantageously combines obstacle detection and sensing with customary visual displays.

In one embodiment, an electromagnetic sensor is installed on a helicopter and the sensor's data is fed to a visual display, such as a TAWS display. The TAWS display provides a depiction of the environment in proximity to the helicopter by comparing the coordinates of the helicopter to an obstacle coordinates database. In this embodiment, the system integrates real time detection of power lines with the obstacle coordinate database to provide an enhanced graphical depiction of power lines detected by the sensors. In some embodiments, the sensors detect 60 or 50 Hz electromagnetic fields radiated by the power lines.

In some embodiments, the system employs audible and visual alarms to alert the pilot to the sensed obstacle. In the helicopter-power line embodiment referenced above, the real time detection might be depicted by modifying the style of the power lines to focus operator attention, such as flashing the power lines or changing the color of the power lines depicted on the TAWS display. In this way, the pilot is provided a visual indication of the helicopter's location relative to the power line, thus helping the pilot identify and avoid an imminent collision. The pilot's attention may remain focused on the visual display and receive a relative positioning of the power line. In some further embodiments, the system may monitor the strength of the detected signal, alerting the pilot if the signal strength is increasing, thereby notifying the pilot that the distance to the power line is decreasing.

The system may also provide a visual indication of power lines which are not contained in the system. For example, indication may be provided when new power lines are installed after an update of the TAWS system or as an aircraft navigates a poorly mapped area, such as a warzone. In this embodiment, the system may also provide a visual depiction of the direction and/or distance of a power line.

In one embodiment, the system provides an audible alert. For example, a Geiger-counter-style alarm which may be programmed to increase the frequency of clicks as the transportation device approaches the obstacle may be generated.

The pilot's situational awareness is also enhanced by the TAWS depiction of obstacles that do not emit radiation within the range of approximately 50-60 Hz. For example, if the aircraft is approaching an obstacle on a collision course, the system may employ the audible alert to attract the pilot's attention to an imminent collision with an obstacle such as a radio tower, ski lift, or building. In other embodiments, the system alerts the pilot to the potential collision while simultaneously providing the pilot with the ability to plot evasive maneuvers. That is, by depicting the confirmed power lines in relation to their neighboring obstacles, a safe flight plan can be quickly determined and adapted.

In one embodiment, the system comprises a positioning system, an obstacle coordinate database, a sensor, and a visual display. The positioning system is operable to determine the coordinates of the helicopter. The obstacle coordinate database includes the coordinates of at least a portion of a power line and the sensor is operable to detect electromagnetic radiation from the power line. In some embodiments, the positioning system and coordinate database comprise a GPS or an EGWPS. The sensor detects AC signals in the range of approximately 50-60 hertz. The visual display is operable to represent a position of the power line relative to the helicopter when the coordinates of the power line are within a predetermined distance of the coordinates of the helicopter, wherein the representation of the position of the power line is modified when the sensor detects electromagnetic radiation from the power line. The representation of the position of the power line may be modified by altering at least one characteristic selected from the group consisting of: a color of the power line, a flash status of the power line, a font, and a graphic. The representation may be further modified if the system detects a probability of collision above a certain threshold.

In some embodiments, an audible alarm is used in conjunction with the visual display. A characteristic of the audible alarm changes when the distance between the power line and the helicopter changes.

In some embodiments, the thresholds governing audible or visual alarms may be adjusted.

In one embodiment, the system includes a method for providing a visual representation of a power line in proximity to a helicopter, including determining the coordinates of the helicopter, accessing an obstacle coordinates database to determine a set of obstacles in proximity to the coordinates of the helicopter, scanning the electromagnetic field surrounding the helicopter for one or more power lines, and displaying the one or more power lines on a visual display.

DETAILED DESCRIPTION

Figures 1A, 1B, 1C:
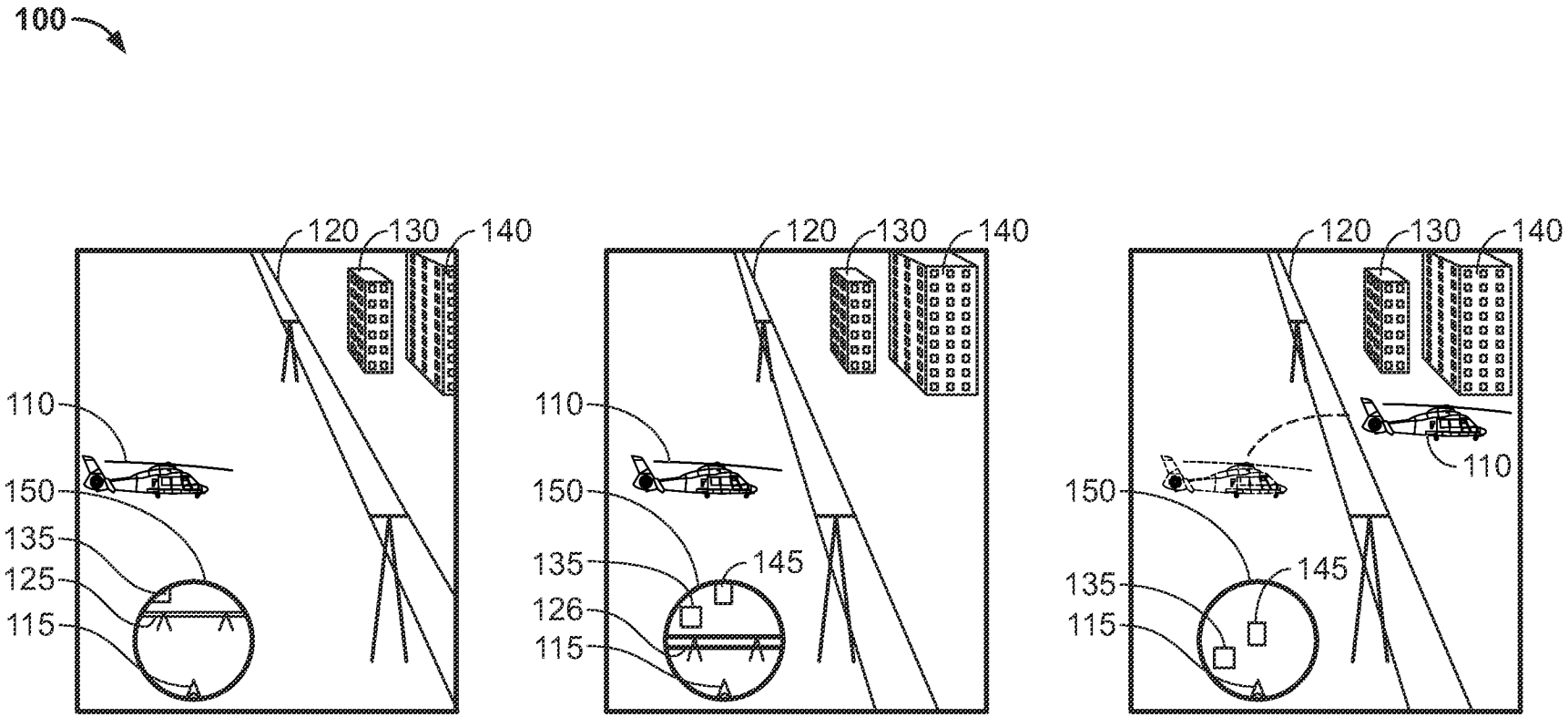
FIG. 1A-1C illustrate an example of the utilization of a system for providing a helicopter with visual notification of an independently confirmed power line.

In the following description of embodiments, reference is made to the accompanying drawings which form a part hereof, and in which it is shown by way of illustration specific embodiments in which the invention may be practiced. It is to be understood that other embodiments may be utilized and structural changes may be made without departing from the scope of the invention.

This relates to a system for detecting and displaying obstacles in proximity to transportation devices. The system advantageously improves operator awareness while simultaneously reducing operator distraction. Also, the system advantageously combines obstacle detection and sensing with customary visual displays.

In one embodiment, an electromagnetic sensor is installed on a helicopter and the sensor's data is fed to a visual display, such as a TAWS display. The TAWS display provides a depiction of the environment in proximity to the helicopter by comparing the coordinates of the helicopter to an obstacle coordinates database. In this embodiment, the system integrates real time detection of power lines with the obstacle coordinate database to provide an enhanced graphical depiction of power lines detected by the sensors. In some embodiments, the sensors detect 60 or 50 Hz electromagnetic fields radiated by the power lines.

In some embodiments, the system employs audible and visual alarms to alert the pilot to the sensed obstacle. In the helicopter-power line embodiment referenced above, the real time detection might be depicted by modifying the style of the power lines to focus operator attention, such as flashing the power lines or changing the color of the power lines depicted on the TAWS display. In this way, the pilot is provided a visual indication of the helicopter's location relative to the power line, thus helping the pilot identify and avoid an imminent collision. The pilot's attention may remain focused on the visual display and receive a relative positioning of the power line. In some further embodiments, the system may monitor the strength of the detected signal, alerting the pilot if the signal strength is increasing, thereby notifying the pilot that the distance to the power line is decreasing.

The system may also provide a visual indication of power lines which are not contained in the system. For example, indication may be provided when new power lines are installed after an update of the TAWS system or as an aircraft navigates a poorly mapped area, such as a warzone. In this embodiment, the system may also provide a visual depiction of the direction and/or distance of a power line.

In one embodiment, the system provides an audible alert. For example, a Geiger counter-style alarm which may be programmed to increase the frequency of clicks as the transportation device approaches the obstacle may be generated.

The pilot's situational awareness is also enhanced by the TAWS depiction of obstacles that do not emit radiation within the range of approximately 50-60 Hz. For example, if the aircraft is approaching an obstacle on a collision course, the system may employ the audible alert to attract the pilot's attention to an imminent collision with an obstacle such as a radio tower, ski lift, or building. In other embodiments, the system alerts the pilot to the potential collision while simultaneously providing the pilot with the ability to plot evasive maneuvers. That is, by depicting the confirmed power lines in relation to their neighboring obstacles, a safe flight plan can be quickly determined and adapted.

In one embodiment, the system comprises a positioning system, an obstacle coordinate database, a sensor, and a visual display. The positioning system is operable to determine the coordinates of the helicopter. The obstacle coordinate database includes the coordinates of at least a portion of a power line and the sensor is operable to detect electromagnetic radiation from the power line. In some embodiments, the positioning system and coordinate database comprise a GPS or an EGWPS. The sensor detects AC signals in the range of approximately 50-60 hertz. The visual display is operable to represent a position of the power line relative to the helicopter when the coordinates of the power line are within a predetermined distance of the coordinates of the helicopter, wherein the representation of the position of the power line is modified when the sensor detects electromagnetic radiation from the power line. The representation of the position of the power line may be modified by altering at least one characteristic selected from the group consisting of: a color of the power line, a flash status of the power line, a font, and a graphic. The representation may be further modified if the system detects a probability of collision above a certain threshold.

In some embodiments, an audible alarm is used in conjunction with the visual display. A characteristic of the audible alarm changes when the distance between the power line and the helicopter changes.

In some embodiments, the thresholds governing audible or visual alarms may be adjusted.

In one embodiment, the system includes a method for providing a visual representation of a power line in proximity to a helicopter, including determining the coordinates of the helicopter, accessing an obstacle coordinates database to determine a set of obstacles in proximity to the coordinates of the helicopter, scanning the electromagnetic field surrounding the helicopter for one or more power lines, and displaying the one or more power lines on a visual display.

FIG. 1 illustrates an exemplary utilization 100 of a system for providing a helicopter with visual notification of an independently detected power line. FIGS. 1A-C depict a helicopter 110 navigating near power lines 120. The power lines 120 are included in a coordinates database, which also includes buildings 130 and 140 in proximity to the device. The obstacles are displayed in a visual display 150, which provides a depiction of the power lines 125 and the buildings 135 and 145. Visual display 150 may be housed in helicopter 110. A depiction of the helicopter 115 is also provided on visual display 150, to orient the helicopter pilot. The series of FIGS. 1A-C illustrates the helicopter 110 approaching, detecting, and evading the power lines 120.

FIG. 1A depicts the helicopter 110 approaching the power lines 120. The visual display 150 shows a corresponding depiction of the power lines 125, in addition to a depiction of a building 135 within the display range of the visual display 150. In FIG. 1A, the power lines are depicted in a "standard" font and color.

FIG. 1B depicts the helicopter 110 a short time later. The helicopter 110 has reduced the distance to the power lines 120. In the visual display 150, the visual characteristics of the depiction of the power lines 126 have been modified to alert the pilot to the detection of the power lines 120. In the exemplary embodiment 100, the color and font of the power lines have changed from gray to heavy black. In other embodiments, the power lines flash to notify the pilot of independent detection. The visual change may be triggered upon a first detection of the power lines 120 by an electromagnetic sensor, or may be triggered when the received electromagnetic signal of the power lines 120 exceeds a preset threshold.

FIG. 1C depicts the helicopter 110 after an evasive maneuver. In this case, the helicopter 110 has increased its altitude, thereby flying over the power lines 120. The visual display 150 renders depictions of the neighboring buildings 135 and 145 only, because the power lines 120 are now behind the helicopter 110. In some embodiments, the depiction of the power lines 120 may not cease until a predetermined distance from the power lines 120 is realized, regardless of whether the power lines 120 are behind the helicopter 110.

Figures 2A, 2B, 2C:
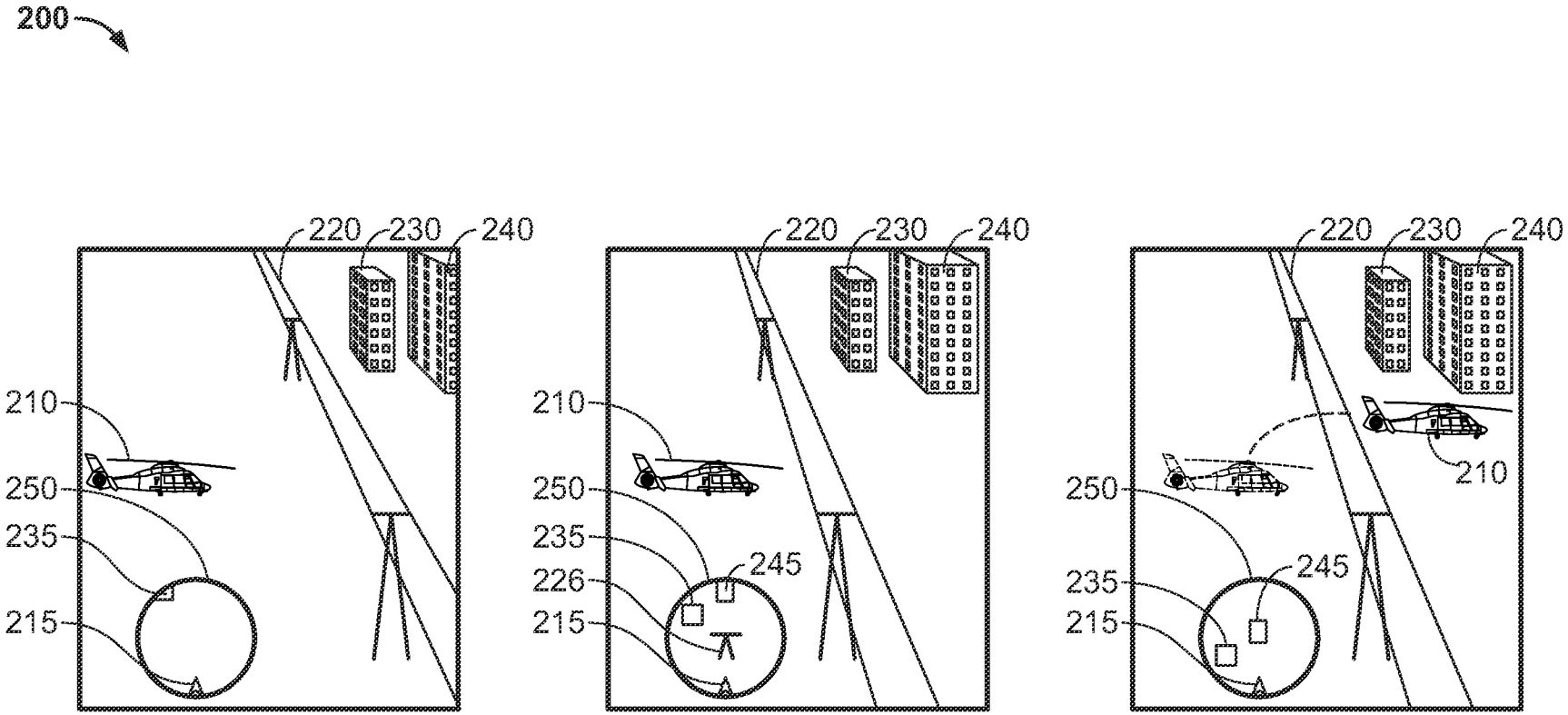
FIG. 2A-2C illustrate an example of the utilization of another system for providing a helicopter with visual notification of an independently confirmed power line.

FIG. 2 illustrates an exemplary utilization 200 of a system for providing a helicopter with visual notification of an independently detected power line. FIGS. 2A-C depict a helicopter 210 navigating near power lines 220.

The utilization illustrated in FIGS. 2A-C is similar to the utilization of FIGS. 1A-C, with the primary difference being that the power lines 220 are not included in the obstacle coordinate database that provides the data used to depict obstacles in the visual display 250. As a result, there is no depiction of the power lines on the visual display 250 prior to the helicopter 210 approaching within a predetermined distance of the power lines 220, as illustrated in FIGS. 2A & B. In this embodiment, the depiction of the detected power lines 220 includes power line tower 226 in the center of the display, as illustrated in FIG. 2B. The tower 226 is exemplary only and any representation that provides the notification function could equivalently be employed. In some embodiments, electromagnetic waves are displayed in the center of the display, or at an edge of the display in a direction of the power line. The direction of a power line may be determined in accordance with U.S. Pat. No. 5,252,912, the disclosure of which is incorporated by reference herein in its entirety. In a further embodiment, one or more characteristics of the waves is altered to represent the signal strength, thereby providing the pilot with an indication of distance to the power lines 220. As with the embodiment of FIGS. 1A-C, the pilot takes evasive maneuvers to avoid the power lines 220, as illustrated in FIG. 2C.

Figure 3:
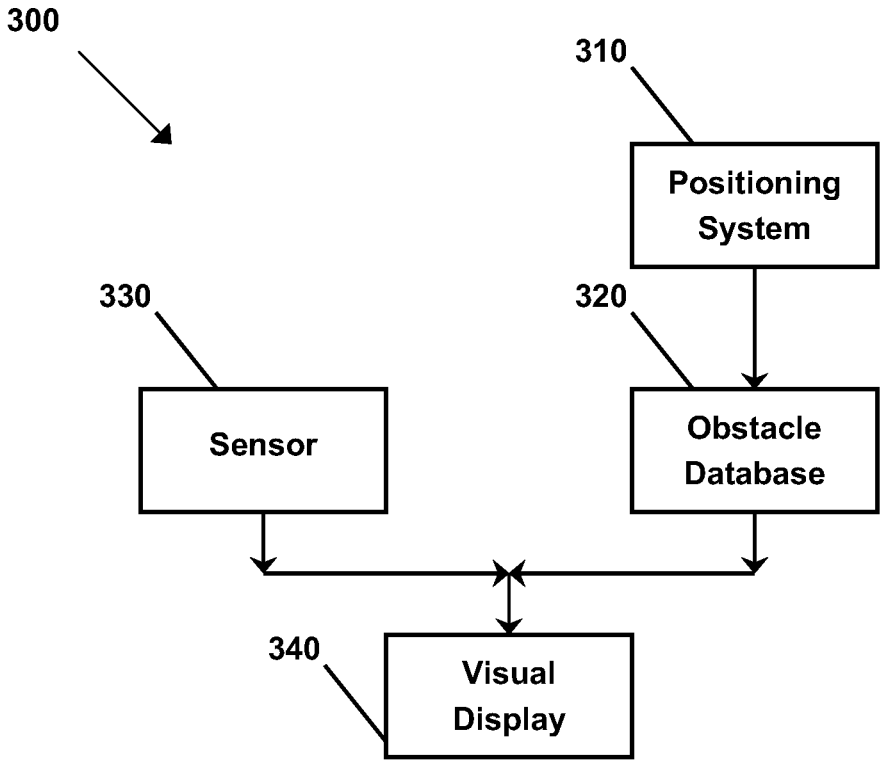
FIG. 3 illustrates an example of an obstacle sensing and notification system.

FIG. 3 is an exemplary embodiment of an obstacle sensing and notification system 300. The obstacle sensing and notification system 300 includes a positioning system 310, an obstacle coordinate database 320, a sensor 330, and a visual display 340.

As described above with respect to FIGS. 1 & 2, the obstacle sensing and notification system 300 provides a transportation device operator with an independent verification of an obstacle in proximity to the device. The individual elements combine to verify an obstacle in proximity to the device and provide a depiction of that obstacle on a visual display. In particular, positioning system 310 determines the coordinates of the transportation device. Based on these coordinates, an obstacle coordinates database 320 provides a set of obstacles in proximity to the transportation device. These obstacles are depicted on the visual display 340 to provide the transportation device operator with an indication of the obstacles to be circumnavigated. Sensor 330 searches for and detects one or more obstacles. These sensed obstacles are also depicted on the visual display 340. The manner of display of the obstacles detected by the sensor 330 will vary, depending on whether those obstacles are also in the obstacle coordinate database 320. The display of the obstacles detected by the sensor may vary for other reasons, such as when the distance decreases between the transportation device and the obstacle.

In one embodiment, the sensor 330 communicates with the positioning system 310, the obstacle coordinate database 320, and visual display 340 through input and output communication ports. In this embodiment, information obtained by the sensor 330 and by the positioning system 310 can be exchanged to advantageously provide both audio and visual alerts to a transportation device operator of all detected obstacles and obstacles in proximity to the device in the obstacle coordinate database 320.

In some embodiments, information on obstacles detected by the sensor 330 may be used to provide alerts on the visual display 340. The output from the sensor 330 may be determined by the proximity of a detected obstacle. For example, the sensor output may activate when an obstacle's signal strength is detected above a first threshold. An audio alarm may then be activated when the obstacle's signal strength is detected above a second threshold. Such an alarm may include the audio signals discussed in U.S. Pat. No. 6,002,348, the disclosure of which is incorporated herein by reference in its entirety. In addition, the sensor 330 may communicate the detection to the visual display 340. This may occur at the first threshold to allow time to identify the detected obstacle in the obstacle coordinate database 320. The visual display may then provide a visual alert—such as a flash or display-color change—of the detected power line, as described above with respect to FIG. 1. If no power line is identified in the obstacle coordinate database 320, the visual display 340 may depict a power line tower, for example, in the middle of the screen, as described above with respect to FIG. 2.

In some embodiments, a characteristic of the output of the sensor is determined by the distance between the transportation device and the obstacle. As the distance varies, this characteristic may vary and be used to change one or more alerts given to the transportation device operator. For example, the audible alert may take the form of a Geiger counter-style series of clicks, the frequency of which increases as the distance to the obstacle decreases. This variance may also be used to enable the visual display 340 to provide a visual alert, such as a change color, a changed flash status, frequency of flash, etc. The audible alert and visual alert may be used in conjunction, but either of the alerts could be used alone.

In some embodiments, information on obstacles detected by the positioning system 310 and the obstacle coordinate database 320 may be used to provide audible alerts via the alarm system associated with sensor 330. In this embodiment, an audible alert associated with the sensor 330 may be utilized to draw the operator's attention to an impending collision of an obstacle other than one detected by the sensor 330. For example, if the positioning system 310 and obstacle coordinate database 320 detect a collision with a building, the audible alert—such as a Geiger counter-style series of clicks—may be utilized to draw the transportation device operator's attention to the impending collision. This embodiment of the invention advantageously allows a transportation device operator to focus on his or her surroundings with the knowledge that he or she will be audibly notified of an impending collision. This is particularly relevant in small aircraft where most operation is performed by looking at surroundings rather than focusing on an instrument panel. In particular, helicopter pilots can sometimes be presented with suddenly varying surroundings and the pilot may not have time to focus on an instrument panel. The system advantageously allows a pilot to react to an audible alarm by scanning his or her surroundings and then looking at his or her display for confirmation or for identification of the obstacle.

The system 300 may determine which obstacle to display in a variety of ways. In one embodiment, once an obstacle is detected by sensor 330, system 300 identifies the coordinates of the obstacle in the obstacle coordinate database 320 which is (1) closest to the transportation device and (2) has the characteristics the sensor 330 is configured to sense. In other embodiments, the system 300 may determine a likelihood of collision and display one or more obstacles which exceed a predetermined likelihood of collision. For example, system 300 may identify obstacles in the obstacle coordinate database 320 which are in the travel path of the transportation device—such as a flight plan of a helicopter—and also have the characteristics which the sensor 330 is configured to sense. In some embodiments, system 300 may apportion weights to proximity, elevation, and flight path, for example, to determine a likelihood of collision and determine one or more obstacles which exceed that threshold. Other weighting factors could also be included in the determination. In other embodiments, the determination of which obstacle to display may include determining the direction of the sensed obstacle. The direction of the obstacle may be estimated by, for example, the power line direction detection system discussed in U.S. Pat. No. 5,252,912, the disclosure of which is incorporated herein by reference in its entirety.

The positioning system 310, obstacle coordinate database 320, and visual display 340 may comprise any known GPS systems—TAWS or EGPWS. The system 300 advantageously integrates an independent obstacle detection system with known visual displays. Such displays are now an aviation standard and pilots are becoming increasingly familiar and dependent upon their functionality. By fusing the obstacle detection and warning system with a visual display, system 300 advantageously eliminates the need for transportation device operators to utilize additional senses to identify and distinguish alerts. The pilot need only reference the visual display to receive notification of potential collision and of the evasive maneuvers available. Of course, obstacle sensing and notification system 300 may also comprise an audible alarm, to draw the pilot's attention to the visual display, for example.

In some embodiments, the system is integrated into the transportation device, such as when the transportation device is first sold. In other embodiments, the system is integrated with a GPS system—such as HeliTAWS™—and added to the transportation device after it is sold. In yet other embodiments, the system is sold as an improvement to an existing GPS system, for example, as a software "patch" for a TAWS and a sensor to detect obstacles.

Although not depicted in FIG. 3, system 300 may also include a computer system, processors, and/or circuitry for interaction of the elements listed above. Such devices are well known in the art.

In one embodiment, sensor 330 is an electromagnetic sensor for detecting alternating current in power transmission lines. In this embodiment, sensor 330 may comprise a low frequency or very low frequency radio and antenna that can be adjusted to respond to a predetermined signal level. The antenna may have a variety of different shapes and lengths as will be understood by persons of ordinary skill in the art. For example, a simple whip antenna and a VLF Radio.

Although discussed herein primarily in terms of electromagnetic sensors, other sensors could be employed in system 330 without deviating from the scope of the present invention. For example, thermal sensors may be used to detect a structure fire. In some embodiments, chemical sensors are used to detect gas leaks in above-ground or underwater piping. As with the emission of electromagnetic energy from power lines, these embodiments detect a characteristic which is naturally emitted from the obstacle. In other embodiments, system 300 may include a source of energy radiated from the transportation device, where the energy reflects from an obstacle and is detected by the sensor 320, such as a radar, sonar, or lidar detector. In this embodiment, the detected obstacle is included within the obstacle coordinates database 320. In some embodiments, system 300 may include a combination of the above sensor types.

Positioning system 310 determines the latitude and longitude of the transportation device, for example, the helicopter 110 shown in FIG. 1. In some embodiments, the positioning system may also determine the altitude, speed, and direction of the transportation device.

In some embodiments, positioning system 310 consists of a Global Positioning System ("GPS"). This is a space-based triangulation system using satellites and computers to measure positions anywhere on earth. In other embodiments, positioning system 310 consists of a land-based orientation system, such as by communicating with radio towers or landmarks of known coordinates. In some embodiments, positioning system 310 may communicate with one or more airborne transportation devices—such as fixed wing aircraft or helicopters—of known coordinates. In some embodiments, positioning system 310 employs a combination of the above.

The obstacle coordinate database 320 includes the latitude and longitude of one or more obstacles. For example, the obstacle coordinate database 320 may include the power lines 120 and buildings 130 and 140 depicted in FIG. 1. Other obstacles in the database may include bridges, terrain, or any other natural or artificial topographical feature. The obstacle coordinate database 320 may be an integral component of a GPS system.

The obstacle coordinate database 320 may include a power line database for a preselected geographical area. This power line grid includes the longitudinal and latitudinal coordinates for all of the power lines within the geographical area. Further, the obstacle coordinate database 320 may include an elevation of the power lines in the geographical area. For example, power lines in certain geographic regions may have a regulated, standard height. In other embodiments, the height of the power lines may be surveyed and entered into the obstacle coordinates database. This additional information may provide pilots with the information necessary to plot evasive maneuvers. In other embodiments, the power line grid might be independently verified by system 300, as described in more detail below.

Visual display 340 includes a dynamic topographical display of obstacles determined to be in proximity to the transportation device. In some embodiments, visual display 340 is an integral component of a GPS system.

When system 300 senses an obstacle through sensor 330, the depiction of the obstacle on visual display 340 is modified to draw the operator's attention. The modification may affect a portion of the depicted obstacle, or all of it. For example, the depiction of that portion of the power lines closest to the transportation device may be modified, or the depiction of all of the displayed power lines may be modified.

Further, the modification may take any form that distinguishes the depiction of the sensed obstacle. For example, a GPS system may have a standard representation color for all obstacles—gray, for example. For a detected power line, the system might change the color to black. In other embodiments, the line is bolded or its thickness increased. In other embodiments, a "flash status" of the depicted power lines changes; for example, the power lines may alternate between being visible and invisible or emphasized and deemphasized. In other embodiments, a symbol of electromagnetic waves surrounds the power lines to indicate a sensed electromagnetic radiation. In other embodiments, text is added to provide information. In yet other embodiments, a combination of the above is used.

Other features may also be employed. For example, when the resolution of the visual display 340 is too low to display a sensed obstacle, arrows or similar indicators may appear at the edge of the display to indicate the direction of the obstacle. In this way, a transportation device operator may view his or her surroundings in as fine a detail as he or she wishes, without fear of first learning of a sensed obstacle when evasive maneuvers are no longer available.

In some embodiments, obstacle coordinate database 320 may not include a sensed obstacle. In this embodiment, the visual display 340 is also programmed to depict the sensed obstacle. In this way, an operator who is accustomed to receiving information via the visual display 340 need not reorient himself or herself to signals received through a different sense, such as via audible signals. This does not preclude the combination of audible signals with the features described above and is described here to illustrate that an advantage of system 300 is the ability to eliminate the need for such audible signals. For example, helicopters are frequently flown to areas of a medical emergency, land, and take-off. These areas are frequently near one or more power lines. It may be necessary to wait on the ground, in the proximity of an accident, while one or more individuals are extricated from the accident and loaded onto the helicopter. During this waiting period, the effectiveness of the visual alarm may wane. In this embodiment, an audible alarm may be used to return the operator's attention to sensed obstacle, especially if the distance to the obstacle decreases. Such an audible alarm may be used in conjunction with a visual alarm or a depiction on the visual display to further orient the transportation device operator.

In some embodiments, an audible alarm provides a backup to the visual display. Any noticeable sound would provide sufficient alarm, such as, but not limited, to buzzers, voice announcements, clicks, and sirens. To alert the operator to a decrease in distance between the obstacle and the transportation device, the audible alarm might change frequency, tone, pitch, or volume.

System 300 may include operator controls for setting warning thresholds. For example, the operator may decide to disengage the warning system when at a certain altitude above or a certain distance away from an obstacle. In the embodiment of FIG. 1, for example, the operator may decide to disengage the warning system when the helicopter 110 is 50 feet above the elevation of the power lines 120. Although the distance to the power lines might still be within a warning threshold, the pilot may decide that this elevation above the power lines provides sufficient safety that distraction by the warning system is not justified. The ability to set these thresholds may vary, depending on the transportation device, the geographic area, and the operator's skill and knowledge.

System 300 may also include a collision detection system. For example, based on a predetermined probability of impacting a sensed or non-sensed obstacle in the database, the modified depiction of a sensed obstacle may change to reflect an increasing likelihood of impact.

In some embodiments, system 300 may include modules for storing data from sensor 330. For example, if system 300 detects an inconsistency between a sensed position and a projected position from the obstacles database, the system may log those inconsistencies for later investigation. In this way, recent, undocumented changes in the topography of a geographic region can be readily identified and the manufacturer of the obstacle coordinate database 320 can be notified of a need to update the system. In some further embodiments, data from a number of transportation devices could be pooled to more accurately detect a topographical change.

In some further embodiments, historical data of sensed obstacle could be used to provide predictions of obstacle locations. For example, for a power line that is not yet in the obstacle coordinate database, a number of readings will suggest the layout of the power lines. This could be combined with real-time detections to give an anticipated layout of the power lines.

In some embodiments, an alert may be disengaged as the signal from the detected obstacle decreases, that is, as the distance between the transportation device and the obstacle increases. However, the radiation of power lines has been known to be erratic—a momentary decrease in signal strength may not coincide with an increase in distance. For that reason, the system 300 may be equipped with a time delay or other analytical algorithm before disengaging an alarm or alert system to confirm that a decreasing signal coincides with an increasing distance.

Although discussed above primarily with respect to airborne transportation devices, any transportation device could enjoy the benefits of system 300 without deviating from the scope of the invention. For example, a boat or submarine may use a sensor to detect piping that is included in an obstacle coordinate database, such as through sensing gas leaks or thermal radiation. Other transportation devices, including automobiles, may also use system 300 in a range of similar applications.

Figure 4:
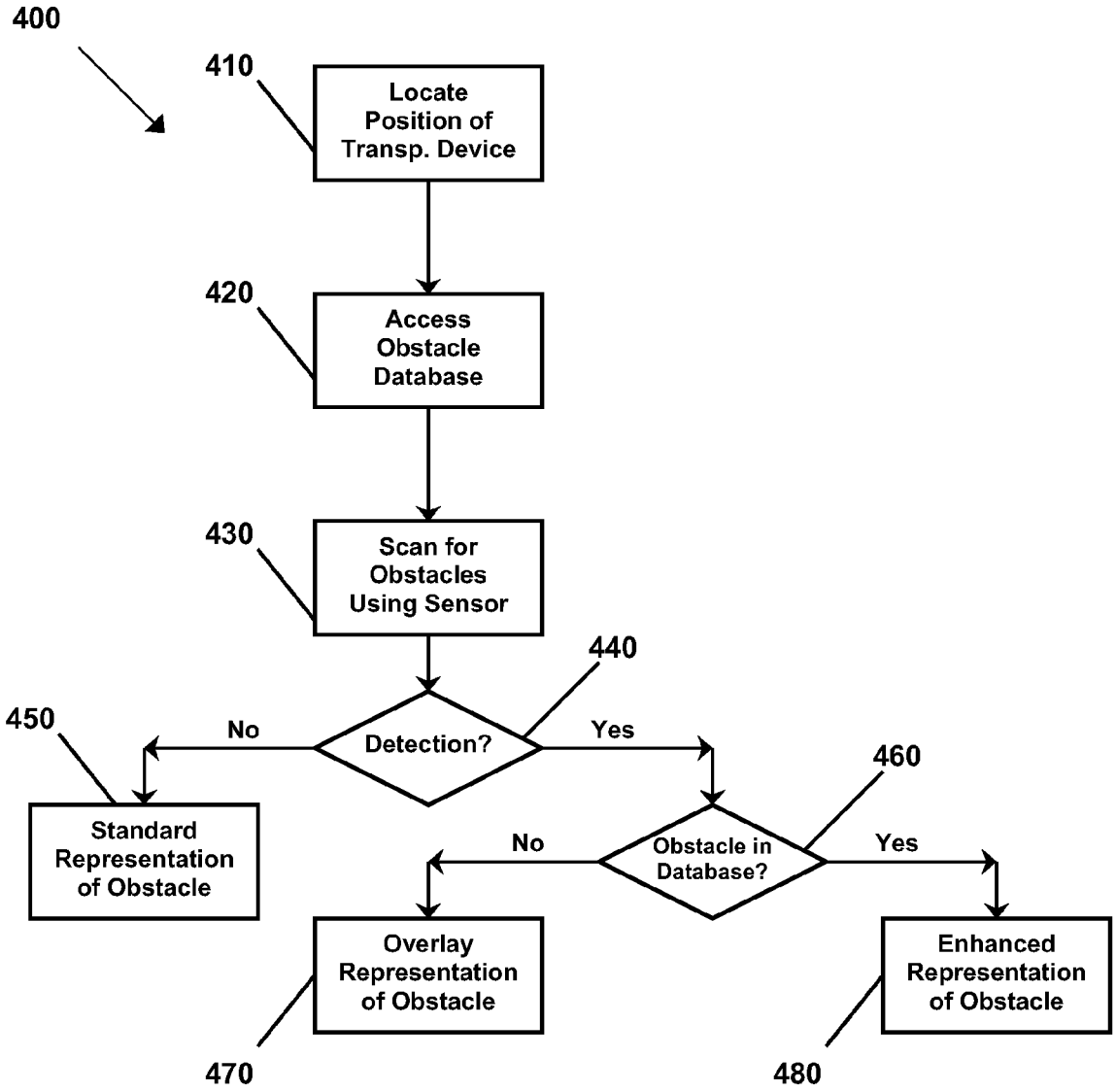
FIG. 4 illustrates an example of a process of obstacle sensing and notification.

FIG. 4 illustrates a block flow diagram of a process 400 of obstacle sensing and notification. The tasks shown in FIG. 4 need not be performed in the illustrated order, and process 400 may be incorporated into a more comprehensive procedure or process having additional functionality not described in detail herein. Process 400 may be implemented using the embodiments illustrated in FIGS. 1-3 and, for illustrative purposes, the following description of process 400 may refer to elements mentioned above in connection with FIGS. 1-3.

As shown in FIG. 4, process 400 includes locating 410 a position of a transportation device, such as helicopter 110 discussed above with respect to FIG. 1. In one embodiment, the position of the transportation device is obtained using a positioning system, such as positioning system 310 discussed above with respect to FIG. 3. Process 400 also includes accessing 420 an obstacle coordinates database, such as obstacle coordinates database 320 discussed above. Process 400 also includes scanning 430 for obstacles using a sensor, such as any of the mechanisms for sensing obstacles discussed herein.

Process 400 includes decision 440, which determines if a standard representation of an obstacle should be rendered. An example is given in FIG. 2, where building 130 of FIG. 1 is not detected by the electromagnetic sensor of helicopter 110. In that case, process 400 moves to step 440 and the "regular' depiction of the obstacle is rendered. Of course, if an obstacle is neither in the database nor detected by the sensor, no depiction is rendered.

If an obstacle is detected by the sensor, process 400 moves to decision 460. Decision 460 determines if the sensed obstacle is also in the obstacle coordinate database, which was accessed in step 420. If the sensed obstacle is in the obstacle coordinates database, process 400 moves to step 480 to render an enhanced representation of the obstacle. For example, power lines 126 in FIG. 1B above. If the sensed obstacle is not in the obstacle coordinates database, process 400 moves to step 470 and overlays the obstacle on the visual display. For example, the electromagnetic waves 226 in FIG. 2B above.

One skilled in the relevant art will recognize that many possible modifications and combinations of the disclosed embodiments can be used, while still employing the same basic underlying mechanisms and methodologies. The foregoing description, for purposes of explanation, has been written with references to specific embodiments. However, the illustrative discussions above are not intended to be exhaustive or to limit the disclosure to the precise forms disclosed. Many modifications and variations can be possible in view of the above teachings. The embodiments were chosen and described to explain the principles of the disclosure and their practical applications, and to enable others skilled in the art to best utilize the disclosure and various embodiments with various modifications as suited to the particular use contemplated.

Further, while this specification contains many specifics, these should not be construed as limitations on the scope of what is being claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A power line warning system for a helicopter, comprising:

a positioning system operable to determine coordinates associated with the helicopter, an obstacle coordinate database comprising coordinates associated with at least a portion of a first power line, a sensor operable to detect electromagnetic radiation associated with the first power line, and a visual display operable to represent a first configuration of relative positions of the first power line and the helicopter when the coordinates associated with the first power line and the helicopter are within a predetermined distance and the electromagnetic radiation associated with the power line is detected as being at or below a first threshold, wherein a representation of the position of the first power line is modified to a second configuration different from the first configuration when the sensor detects electromagnetic radiation associated with the first power line above the first threshold.

2. The system of claim 1, wherein the sensor is operable to detect an AC signal of approximately 50-60 hertz.

3. The system of claim 1, wherein the representation of the position of the first power line is modified by altering at least one characteristic selected from the group consisting of: a color of the first power line, a flash status of the first power line, a font, and a graphic.

4. The system of claim 1, wherein the representation of the position of the first power line is modified when the system determines that the helicopter has a predetermined probability of colliding with the first power line.

5. The system of claim 1, comprising an audible alarm operable to activate when the helicopter is within a predetermined distance from the power line.

6. The system of claim 5, wherein a characteristic of the audible alarm changes when a distance of the power line from the helicopter changes.

7. The system of claim 1, wherein the positioning system and obstacle coordinate database comprise a global positioning system.

8. The system of claim 1, wherein the positioning system and obstacle coordinate database comprise an enhanced ground proximity warning system.

9. The system of claim 1, comprising an adjustment control operable to deactivate modification of the visual representation when the helicopter meets a predetermined criterion.

10. The system of claim 9, wherein the predetermined criterion is an altitude.

11. The system of claim 1, wherein the visual display is located in the helicopter.

12. The system of claim 1, wherein the visual display is operable to represent a second power line, wherein the obstacle coordinate database does not comprise the second power line, and wherein the sensor is operable to detect electromagnetic radiation from the second power line.

13. A method for providing a visual representation of a power line in proximity to a helicopter, the method comprising:

determining the coordinates of the helicopter, accessing an obstacle coordinates database to determine a set of obstacles in proximity to the coordinates of the helicopter, scanning an electromagnetic field surrounding the helicopter for one or more power lines, displaying the one or more power lines on a visual display in a first configuration when the one or more power lines are determined to be in the set of obstacles and scanning the electromagnetic field surrounding the helicopter detects electromagnetic radiation at or below a first threshold, and displaying the one or more lines on the visual display in a second configuration different from the first configuration when scanning the electromagnetic field surrounding the helicopter detects electromagnetic radiation above the first threshold.

14. The method of claim 13, wherein displaying the one or more power lines comprises one selected from the group consisting of a standard representation, an overlay representation, and an enhanced representation.

15. The method of claim 13, wherein scanning the electromagnetic field comprises scanning in the range of 50-60 hertz.

16. The method of claim 13, wherein displaying the one or more power lines comprises modifying a visual characteristic of the displayed one or more power lines.

17. The method of claim 13, wherein the helicopter comprises a global positioning system.

18. The method of claim 13, wherein the helicopter comprises a terrain awareness and warning system.

19. The system of claim 13, comprising an audible alarm operable to activate when the helicopter is within a predetermined distance from the power line.

20. The system of claim 19, wherein a characteristic of the audible alarm changes when a distance of the power line from the helicopter changes.

21. A power line warning method, comprising:

determining coordinates associated with a helicopter, detecting electromagnetic radiation associated with a power line, determining if coordinates associated with at least a portion of the power line are stored in an obstacle coordinates database, providing a visual display comprising a representation of the power line and the helicopter in a first configuration when electromagnetic radiation associated with the power line is detected as being at or below a first threshold, and modifying a visual characteristic of the representation of the power line to provide a second configuration different from the first configuration when electromagnetic radiation associated with the power line is detected above the first threshold and coordinates associated with at least a portion of the power line are determined to be stored within an obstacle coordinates database.

* * * * *